US011793282B2

(12) United States Patent
Nalon et al.

(10) Patent No.: US 11,793,282 B2
(45) Date of Patent: Oct. 24, 2023

(54) JEWELRY ARTICLE WHICH CAN BE DISASSEMBLED

(71) Applicants: Roberto Nalon, Valenza (IT); Armando Pino, Valenza (IT)

(72) Inventors: Roberto Nalon, Valenza (IT); Armando Pino, Valenza (IT)

( * ) Notice: Subject to any disclaimer, the term of this patent is extended or adjusted under 35 U.S.C. 154(b) by 127 days.

(21) Appl. No.: 17/428,045

(22) PCT Filed: Feb. 17, 2020

(86) PCT No.: PCT/IB2020/051301
§ 371 (c)(1),
(2) Date: Aug. 3, 2021

(87) PCT Pub. No.: WO2020/170107
PCT Pub. Date: Aug. 27, 2020

(65) Prior Publication Data

US 2022/0104592 A1 Apr. 7, 2022

(30) Foreign Application Priority Data

Feb. 18, 2019 (IT) ..... 102019000002325

(51) Int. Cl.
*A44C 17/02* (2006.01)

(52) U.S. Cl.
CPC ..... *A44C 17/0233* (2013.01)

(58) Field of Classification Search
CPC ..... A44C 17/0233; A44C 9/0084; A44C 15/0025; A44C 17/0208; A44C 17/0216; A44C 17/0225; A44C 17/02; A44C 9/00; A44C 9/0053
USPC ..... 63/29.1, 40
See application file for complete search history.

(56) References Cited

U.S. PATENT DOCUMENTS 464,810 A * 12/1891 Bonner ..... A44C 17/0208 63/29.1
949,657 A * 2/1910 Murin ..... A44C 17/02 63/26
1,182,534 A * 5/1916 Driggott ..... A44C 17/0208 63/29.1

(Continued)

FOREIGN PATENT DOCUMENTS

CN 201451699 U 5/2010
FR 1378979 A * 11/1964

(Continued)

*Primary Examiner* — Jack W Lavinder
(74) *Attorney, Agent, or Firm* — Gearhart Law, LLC; David Postolski

(57) ABSTRACT

A jewelry article (10, 110, 210) with an ornamental element (11) comprises a ring nut (12) with an internal seat (13) provided at one end of the ring nut with a first opening (14) for introduction of the ornamental element (11) and at an opposite end with a second opening (15) from which the ornamental element (11) emerges. A closing cap (16) closes the first opening (14) after the introduction of the ornamental element (11) into the seat (13). The closing cap (16) comprises a first peripherally threaded disk (18) and a second disk (19) with a face (24) which is intended to form an external closing surface of the first opening (14) of the ring nut. The two disks (18, 19) are fixed to each other. Fixing may be performed by means of fastening pins (26).

13 Claims, 4 Drawing Sheets

(56) References Cited

U.S. PATENT DOCUMENTS

| | | | | |
|---|---|---|---|---|
| 1,864,371 | A * | 6/1932 | Prussian | A44C 17/0233 63/26 |
| 2,316,225 | A | 4/1943 | De et al. | |
| 5,992,177 | A | 11/1999 | Beard | |
| 9,756,909 | B1 | 9/2017 | Bonner | |
| 2004/0237587 | A1 | 12/2004 | Dubnicka | |
| 2017/0020247 | A1 * | 1/2017 | Petrosyan | A44C 17/0233 |

FOREIGN PATENT DOCUMENTS

| | | | |
|---|---|---|---|
| FR | 2933275 | A1 | 1/2010 |
| JP | H09224724 | A | 9/1997 |
| WO | 2014048212 | A1 | 4/2014 |

* cited by examiner

JEWELRY ARTICLE WHICH CAN BE DISASSEMBLED

CROSS REFERENCE TO RELATED APPLICATION

This application is a national stage application of PCT application number PCT/IB2020/051301 filed Feb. 17, 2020, which claims priority to Italian patent application No. 102019000002325 filed Feb. 18, 2019, both disclosures are incorporated herein by reference.

The present invention relates to jewelry articles which are designed so that they can be disassembled In particular, the jewelry articles are advantageously finger rings, earrings, pendants and the like and they may be disassembled so that ornamental elements, such as machined stones, may be replaced.

In the jewelry sector articles which have an inset ornamental element fixed inside them are known. The known fixing techniques involve essentially the gluing or deformation of suitable parts of the jewelry body against the ornamental element. In particular, it is known to perform the coining of the continuous edges of a seat formed in the jewelry article or the deformation of special gripping clips.

In the case where the ornamental element must be replaced for any reason (for example because it is in a poor condition), the operation must be performed in a jewelry workshop using suitable tools and, in some cases, this operation may not always not be successfully completed, for example because deformation of the structure retaining the ornamental element is such that the attempt to free the ornamental element causes the breakage or damage of the structure itself.

Moreover, the removal attempts may also damage irreparably the ornamental element (for example, in the case of hard stones, cracking or splintering of the stone may often occur).

Other fixing systems which facilitate removal have been proposed (for example jewels with several parts which may be easily separated in order to release the ornamental element), but these systems in general conflict with the esthetic needs of the jewelry, where it is preferred that separation zones around the esthetic elements such as the inset stones and the like should not be visible. Moreover, these known solutions alter or ruin the esthetics of the jewelry.

The general object of the present invention is to provide jewelry articles with a structure which allows easy removal of the esthetic elements mounted in them, but which at the same time does not alter substantially the esthetics of the articles, compared, for example, to fixing performed by means of coining or gluing.

In view of this object the idea which has occurred is to provide, according to the invention, a jewelry article with an ornamental element, comprising:

- a ring nut with an internal seat which is provided with an internal thread and which is provided at one end of the ring nut with a first opening for introducing the ornamental element and at an opposite end with a second opening from which the ornamental element is designed to emerge without being able to pass completely through this second opening;
- a closing cap with closes the first opening after the introduction of the ornamental element into the seat in order to keep the ornamental element in the seat; the closing cap comprising in turn:
- a first disk with a first face and a second face opposite to the first face and a side edge surface between the two faces which is threaded in a complementary manner to the internal thread in the ring nut so as to be screwed into this ring nut;
- a second disk with a first face which is designed to form an external closure surface of the said first opening of the ring nut and an opposite second face resting against the first face of the first disk; the first and second disks being coaxially fastened together.

In order to explain more clearly the innovative principles of the present invention and its advantages compared to the prior art, a number of examples of embodiment applying these principles will be described below with the aid of the attached drawings. In the drawings.

Figure 1:
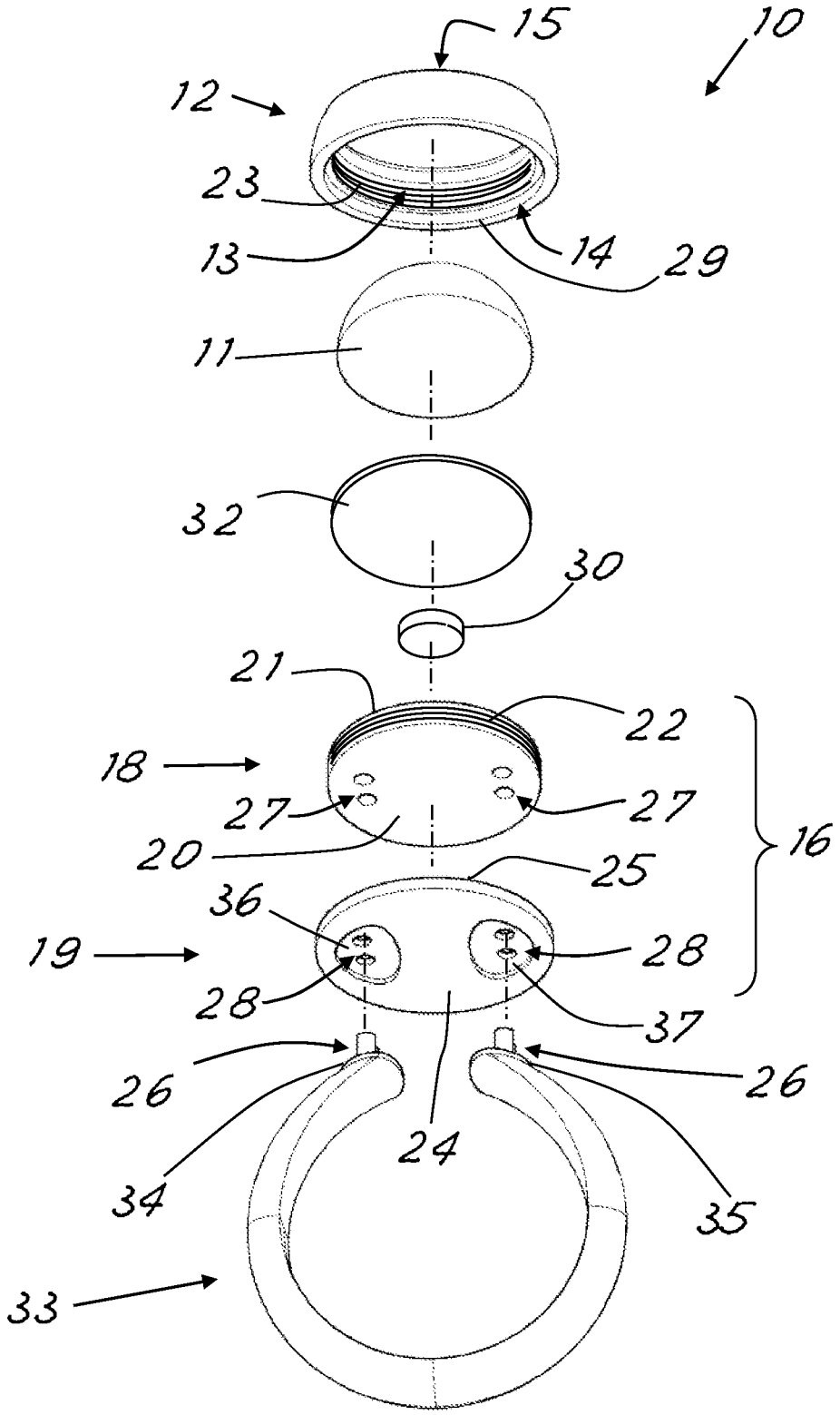
FIG. 1 shows an exploded schematic view of a jewelry article made in accordance with the principles of the present invention.

With reference to the figures, FIG. 1 shows an exploded view of a jewelry article according to the invention, denoted generally by 10. By way of example FIG. 1 shows an article 10 in the form of a ring.

The article 10 comprises an ornamental element 11 which must emerge from the body of the jewelry element and be stably fastened thereto. For example, the ornamental element may be a stone or the like. The stone may be a precious, semi-precious or hard stone. In particular, the figures show a stone which has been machined so as to have a semi-spherical shape.

The ornamental element may also be for example a metal element which has been machined and/or has inset therein further small-size stones.

The article 10 comprises a ring nut 12 with an internal seat 13 which is provided at one end of the ring nut with a first opening 14 for introduction of the ornamental element 11 and at the opposite end with a second opening 15 from which the ornamental element is designed to emerge without being to pass completely through this second opening. For example, the opening 15 may have a size smaller than that of the opening 14 and the maximum transverse dimension of the element 11 may have a size between that of the opening 14 and the size of the opening 15. The openings may in particular be circular, as can be clearly seen in FIG. 1.

Alternatively other known systems may be envisaged (for example machining of the opening 15) in order to prevent the element 11 from coming out through this opening.

A thread 23 is present inside the ring nut within a band between the two ends.

The article 10 also comprises a closing cap 16 which closes the first opening 14 after the ornamental element 11 has been arranged in position in the seat 13 so as to emerge correctly from the opening 15.

As can be seen again in FIG. 1, the closing cap 16 is advantageously formed by a first disk 18 and by a second disk 19.

The first disk 18 has a first face 20 and a second opposite face 21 and a side edge surface 22 between the two faces.

The surface 22 is threaded in a complementary manner to the thread 23 on an internal circumferential wall of the ring nut so that the disk 18 is able to be screwed into the ring nut, engaging with the internal thread 23.

The second disk 19 has in turn a first face 24 which is intended to form an external closing surface of the opening 14 of the ring nut, while the opposite face 25 is intended to rest against the first face 20 of the other disk 18.

The disks 18 and 19, which are formed separately, are stably fastened together in a coaxial position and face-to-face so as to form the cap 16.

For example, in the embodiment shown in FIG. 1, the disks 18 and 19 which form the cap 16 are passed through by pins 26 (for example, two pairs of pins) which stably fasten together coaxially the two disks against each other. For this purpose, the disks have suitable through-holes 27 and 28. Alternatively or in addition, the disks may be fastened together by means of other known methods, such as gluing or welding. Advantageously, as will be clarified below, in the case of welding, said welding may be performed inside special through-seats formed preferably on the inner disk.

Figure 2:
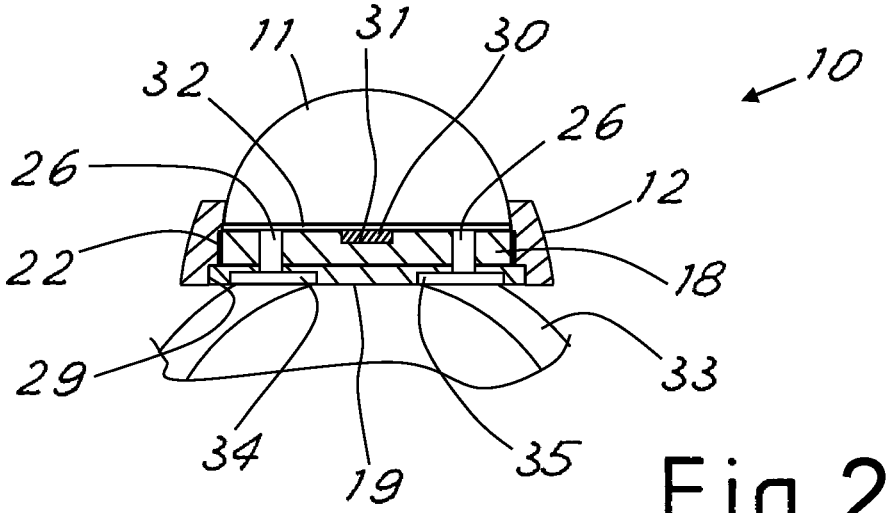
FIG. 2 shows a partially sectioned schematic view similar of a part of the article according to FIG. 1.

The assembled condition of the various parts in FIG. 1 is for example shown in FIG. 2.

Firstly the two disks are fastened together (for example by means of corresponding pins 26) in order to form the cap. This operation must usually be performed once only when the article is initially assembled.

In the case where pins are used to fix together the two disks, these pins may be riveted or welded (for example using a laser beam) so as to fasten together the two disks stably.

Once the cap has been formed, it may be screwed into the ring nut after introduction of the esthetic element 11.

As can be clearly seen in FIG. 2, the disk 19 (or outer disk) is advantageously housed inside a seat 29 in the ring nut so as to have its outer face 24 flush with the edge of the ring nut.

The zone or band where the thread 23 is present inside the ring nut is situated further inside the ring nut than the seat 29 and the inner disk 18 may have a diameter slightly smaller than the outer disk 19. The thread is therefore invisible once the jewelry article has been assembled.

Moreover, owing to the two-disk structure, the inner disk 18 may be completely threaded over the whole thickness of its edge before assembly with the other disk 10, and therefore it ensures an adequate closing force even if made with a small thickness (for example even only one millimeter or less than one millimeter). The entire cap may have a very small thickness.

Advantageously, an elastic element 30 which forms an elastic support for the ornamental element inside the seat of the ring nut may be inserted between the inner disk 18 and the ornamental element 11. In this way, the ornamental element is prevented from moving inside the seat once the ring nut has been closed with the screw cap 16 formed by the two disks 18 and 19 assembled together. Moreover, the elastic thrust helps avoid accidental unscrewing. Preferably, the inner disk 18 may have a seat 31 which partially houses the elastic element so as to keep it stably in position during closing of the article 10. The seat 31 and the elastic element 30 will have heightwise dimensions so that, in the rest condition, the elastic element projects sufficiently from the seat to provide sufficient pressure on the ornamental element 11 once the article has been assembled and to absorb any axial play. The elastic element may be for example made in the form a pad of elastically yielding material (for example rubber) or in the form of a spring.

As can be seen in FIG. 1, a third covering disk 32 may be present between the face 21 of the inner disk 18 and the ornamental element. This disk may be useful in the case of an ornamental element 11 made of transparent or translucid material, in order to prevent the face 21 of the inner disk 18 with the heads of the pins and any elastic element 30 from being visible through the ornamental element. The face of the third disk 32 which is directed towards the ornamental element 11 may be advantageously made shiny, reflective and/or colored so as to provide a desired optical effect through the ornamental element 11.

The article provided according to the invention may easily form various types of jewelry articles, such as a ring, an earring, a pendant, a bracelet, a necklace, a brooch, etc.

Depending on the type of jewelry article which is to be made, suitable wearing structures to be combined with the assembly formed by the disks and by the ring nut will be provided.

For example, the structure which allows wearing of the jewelry article may be fixed to the disks so as to project from the outer face of the disk 19. The fixing may be for example obtained by means of special pins. Advantageously, in the case of the pins 26 which lock together the two disks 18 and 19, these pin may project at least partly from a structure which allows the wearing of the jewelry article.

Figure 3:
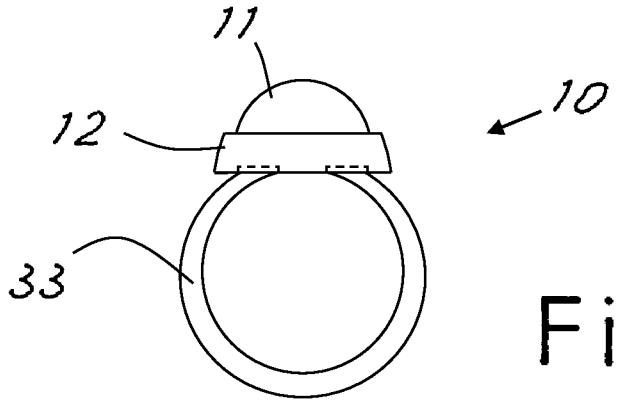
FIG. 3 shows a schematic view of the article according to FIG. 1 completely assembled.

For example, in FIGS. 1, 2 and 3, the wearing structure is an annular structure 33 such that the jewelry article 10 is in the form of a ring.

In this case, the structure 33 (for example C-shaped) may have free ends 34 and 35 from which the pins 26 project. Preferably, as can be clearly seen for example in FIG. 2, these ends may have two bases housed inside special complementary seats 36, 37 formed in the face 24 of the outer disk 19. For example, the seats and the bases may have a generally oval-shaped form. This allows the annular structure to be combined very solidly with the disks so as form a strong assembly able to withstand the opening and closing force of the ring nut. With the use of the pins it is also possible to avoid any external welding and any assembly marks.

Owing to the principles of the invention, once the jewelry article 10 has been completely assembled, it appears as a single piece, as can be seen for example in FIG. 3. However, it may be easily disassembled and reassembled by unscrewing the cap, and the ornamental element 11 may be easily replaced. In the ring-shaped article shown in FIGS. 1, 2 and 3, disassembly is facilitated by the structure 33 which allows the cap 16 formed by the disks 18 and 19 fixed together to be rotated axially on the ring nut 12.

FIGS. 4 to 7 show a second possible embodiment of a jewelry article according to the invention forming an earring (generally indicated by 110). For this purpose, the structure of the part formed by the ring nut 12, the two disks 18, 19, and a third disk 32 and elastic element 30 if present, may be substantially the same as those already described above for retaining the ornamental element 11, while the wearing structure (denoted generally by 133) will be suitably formed for fixing to the lobe of an ear. For example, the structure 133 may be formed by a pin 133*a* and by a rotating safety clip 133*b*.

The pin 133*a* and the clip 133*b* may have respective bases against the disk 19, provided with the fixing pins 26 which also allow the fixing together of the two disks 18 and 19.

Figure 4:
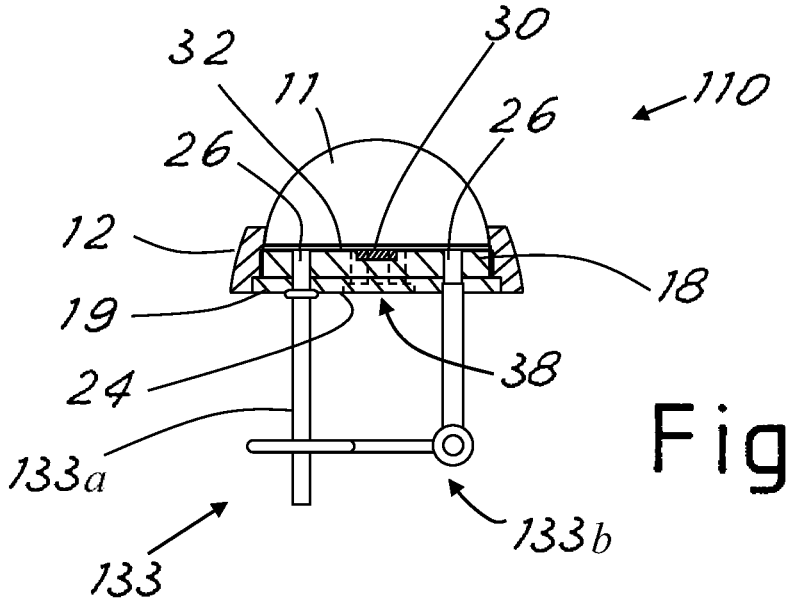
FIG. 4 shows a partially sectioned schematic view of a second embodiment of a jewelry article in the form an earring, according to the present invention.
Figure 5:
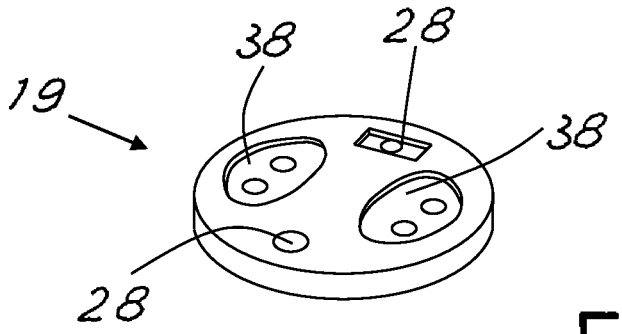
FIGS. 5 and 6 show schematic perspective views of parts of the article according to FIG. 4.

If the wearing structure should be too weak or difficult to grip in order to use as an aid for rotating the disks in the ring nut, a tool for axially rotating the disk may also be used. For this purpose, advantageously the outer disk may have on its visible surface 24 a suitable seat for engagement with the rotation tool. For example, FIGS. 4 and 5 show engaging seats 38. These seats may for example comprise suitable engaging holes for a rotation tool. The tool may be for example formed with engaging ends similar to the ends 34, 35 of the ring-like structure 33 according to FIG. 1 and the engaging seats may be similar to the seats with the holes 28. Advantageously, it may also be substantially the same as the ring-like structure 33 shown in FIG. 1, but made of inferior quality material (for example steel). The pins of the tool may be shorter than those of the ring-like structure to be fixed to the disks since it is not required for them to emerge from the holes of the inner disk, since they do not have to be fixed and because preferably the holes for receiving the pins of the tool should be blind, as can be seen in FIG. 6, so as to prevent for example dirt from entering inside the jewel.

For example, as can be seen in FIG. 5, in the earring 110 the engaging seats 38 may be arranged on the disk 19 along a diameter at right angles to a diameter on which the holes 28 for the pins for fixing together the two disks 18 and 19 are arranged.

Figure 6:
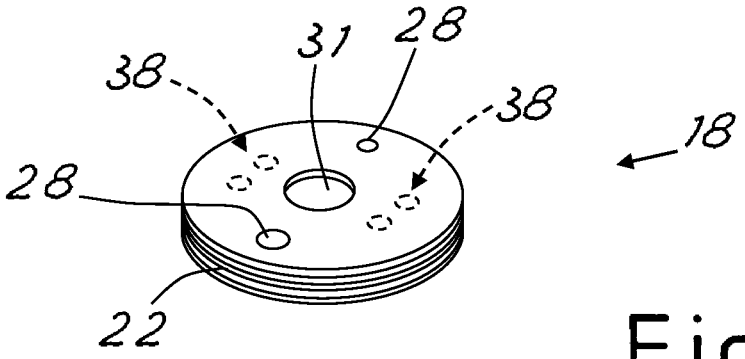
Figure 7:
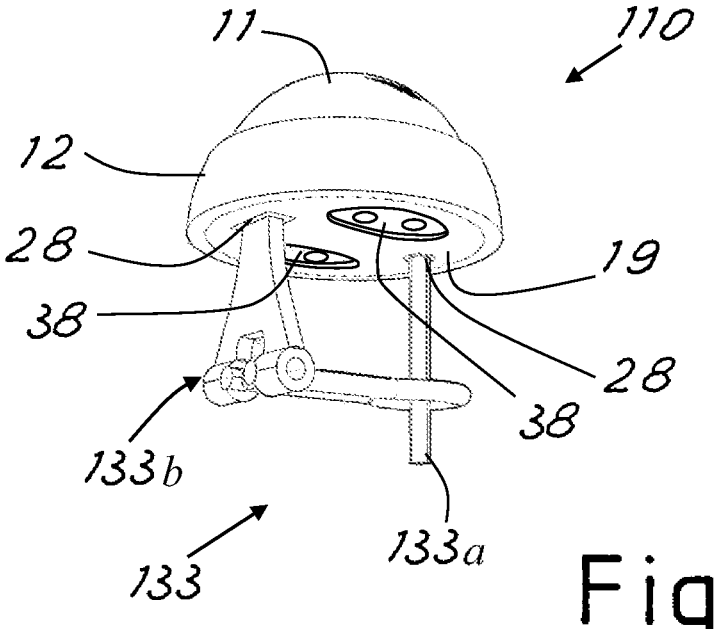
FIG. 7 shows a perspective schematic view of the article according to FIG. 4.

Advantageously, the engaging seats 38 may extend with holes also inside the inner disk 18, as can be seen in FIG. 6, for receiving the engaging ends of the rotation tool and uniformly distributing the rotation action on both disks 18 and 19 without putting the fixing pins 26 under excessive strain.

Figure 8:
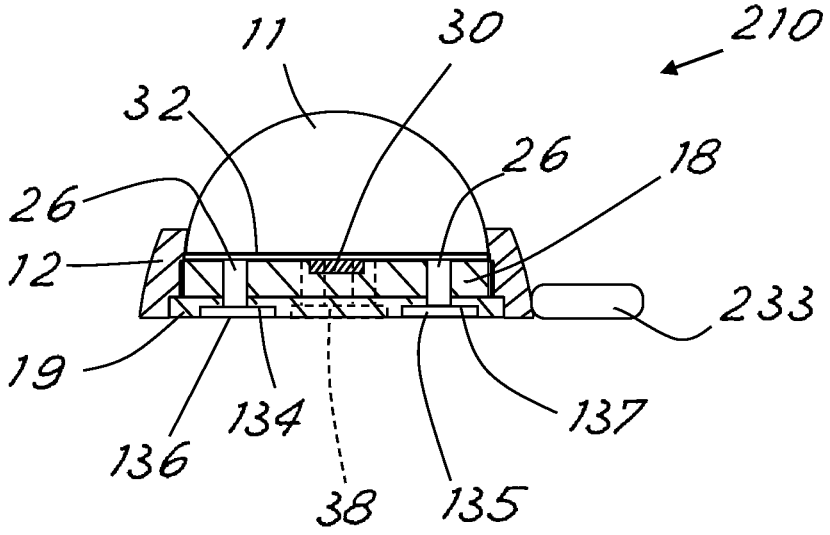
FIG. 8 shows a partially sectioned schematic view of a third embodiment of a jewelry article in the form a pendant, made in accordance with the principles of the present invention.

By way of example, FIG. 8 shows a further possible embodiment of a jewelry article according to the invention forming a pendant (indicated generally by 210). For this purpose, the structure of the part formed by the ring nut 12, the two disks 18, 19, and the third disk 32 and elastic element 30 if present, may be substantially the same as those already described above for retaining the ornamental element 11, while the wearing structure may be formed also as a simple ring 233 projecting laterally from the ring nut 12 so as to be passed through by a chain (not shown), thus creating for example the pendant of a bracelet or a necklace. Alternatively, the same ring nut may be configured as a suitable lateral seat.

As can be seen in FIG. 8, if pins 26 for fixing together the two disks 18 and 19 are used, these pins may be formed so as to not project from the visible face of the outer disk 19. For example plates 136, 137 may be provided, these being housed in seats 134, 135 in the visible face of the disk 19.

Alternatively, any pins 26 may project directly from the inner face of the disk 19 and be integral with this disk (for example welded onto the inner face of the disk 19).

Obviously, the rings 233 may also be two in number, on opposite sides of the ring nut, so as to receive two free ends of a bracelet or necklace section, as may now be easily imagined by the person skilled in the art.

Figure 9:
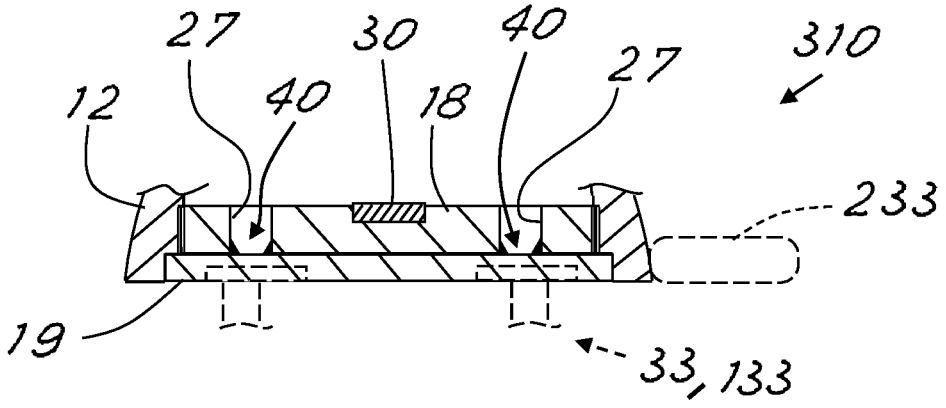
FIG. 9 shows a partially sectioned schematic view of a possible further embodiment of a jewelry article according to the present invention.

FIG. 9 shows a variation of embodiment of the jewelry article part formed by the two disks 18 and 19 and by the ring nut 12.

In the embodiment of FIG. 9, indicated generally by 310, the two disks 18 and 19 are fastened together by means of welding.

Advantageously, the inner disk 18 is formed with through-holes 27 which allow welds 40 to be made such that they emerge on the face of the disk 18 opposite the disk 19.

In this way the welds 40 remain inside the jewelry accessory and therefore are invisible once the accessory is assembled. The number and position of the holes 27 may be chosen so as to ensure the desired strength. For example, four holes 27 may be equally distributed around the circumference of the disks.

The remainder of the article 310, not shown in FIG. 9, may be made in a manner similar to any one of the corresponding parts already described above for the other embodiments. In particular, the wearing structure may be similar to any of the wearing structures (partially shown in broken lines in FIG. 9), as already described above. As is clear to the skilled person from the description provided, the solution shown in FIG. 9 may also be incorporated in the embodiments already described above. If desired, in order to unscrew the cap, a special tool which is engaged in special holes provided in the disks may always be used.

At this point it is clear how the objects of the invention are achieved.

A jewelry article made according to the principles of the present invention may be easily made and is very strong. Moreover, once assembled, it appears to be formed essentially by a single piece in which the ornamental element is inset, but at the same time it may be easily disassembled, for example in order to replace the ornamental element.

Several ornamental elements (for example made of different materials or with different colors) may also be provided, these being able to be easily interchanged by the owner of the jewelry depending on the needs at any one time.

Owing to the structure according to the invention, it is possible to use high-quality materials (for example gold) combined with materials having a different strength for the internal parts of the article, or the entire articles may be made of high-quality materials.

Although, in order to change the ornamental element, it is not required to disassemble the cap into its component parts, if necessary it is possible to do so simply by breaking the fastening of the pins (for example if the inner disk must be replaced because its thread has been damaged). If the pins have been fixed in place by means of a small weld of suitable strength on their heads, this weld can be simply broken in order to separate the disks.

Using preferably a laser weld, the welded parts may be disassembled with minimum effort. It is thus possible to replace only the parts which for example are damaged, without having to replace the entire jewelry article.

It is also easy to provide for example a ring for any finger size by simply effecting a replacement, or assembling on the remaining part, the annular part of suitable size.

The various parts may be easily obtained by means of high-precision machining, while the annular part may be for example made using a lost-wax casting process.

Owing to the principles of the invention, the height of the ring nut including the caps may be kept also very small, while always ensuring a satisfactory strength.

Obviously, the above description of the embodiments applying the innovative principles of the present invention is provided only by way of example of these innovative principles and must therefore not be regarded as limiting the scope of the rights claimed herein.

For example, the wearing structure may be different from those shown and be formed in any known manner depending on the technical and aesthetic requirements.

In particular, if a brooch is to be made, the two parts of the earring shown in FIG. 4 may be replaced by the two halves of a safety brooch, as may now be easily imagined by the person skilled in the art.

Moreover, the forms and proportions of the various parts forming the jewelry article according to the invention may be different from those shown here, depending on technical requirements and particular esthetic needs. For example, the ornamental element may project by a greater or smaller amount from the ring nut or may not project at all and be visible simply through the opening 15 of the ring nut.

What is claimed is:

1. Jewelry article with an ornamental element, comprising:

a ring nut with an internal seat which is provided with an internal thread and which is provided at one end of the ring nut with a first opening for introducing the ornamental element in the internal seat and at an opposite end with a second opening from which the ornamental element is designed to emerge without being able to pass completely through said second opening;

a closing cap which closes the first opening after an introduction of the ornamental element into the internal seat in order to keep the ornamental element in the internal seat;

the closing cap comprising:

a first disk with a first face and a second face opposite to the first face and a side edge surface between the first face and the second face which is threaded in a complementary manner to the internal thread in the ring nut so as to be screwed into this ring nut;

a second disk with a first face which is designed to form an external closure surface of said first opening of the ring nut and an opposite second face intended to rest against the first face of the first disk; the first and second disks being coaxially fastened together.

2. The jewelry article according to claim 1, characterized in that the first and second disks are coaxially fastened together by means of pins for fastening together the first and second disks.

3. The jewelry article according to claim 2, characterized in that the pins for fastening together the first and second disks project at least partly from a structure for wearing the jewelry article.

4. The jewelry article according to claim 3, characterized in that the structure for wearing the jewelry article is an annular structure for forming a ring.

5. The jewelry article according to claim 3, characterized in that the structure for wearing the jewelry article is a clip-like structure for forming an earring.

6. The jewelry article according to claim 1, characterized in that in the first disk there are holes passing through the first disk, the holes having an end in contact with the second disk and the first and second disks are coaxially fastened together by means of welds formed on the end of the holes in contact with the second disk.

7. The jewelry article according to claim 1, characterized in that an elastic element which provides an elastic support for the ornamental element in the internal seat in the ring nut is located on the second face of the first disk.

8. The jewelry article according to claim 7, characterized in that the second face of the first disk comprises a seat for at least partial housing of the elastic element.

9. The jewelry article according to claim 7, characterized in that the elastic element is a pad made of elastically yielding material or a spring.

10. The jewelry article according to claim 1, characterized in that a third covering disk is present between the second face of the first disk and the ornamental element.

11. The jewelry article according to claim 1, characterized by being a finger ring or an earring or a pendant or a brooch or a bracelet or a necklace.

12. The jewelry article according to claim 1, characterized in that on the first face of the second disk there is at least one seat intended for engagement with a tool for axial rotation of the second disk for unscrewing/screwing the second disk from/into the ring nut.

13. The jewelry article according to claim 1, characterized in that the ring nut comprises an element for hanging the jewelry article.

* * * * *